US012345006B2

(12) United States Patent
Haddad et al.

(10) Patent No.: US 12,345,006 B2
(45) Date of Patent: Jul. 1, 2025

(54) METHOD AND ARRANGEMENT FOR MONITORING A STRUCTURAL FOUNDATION

(71) Applicant: BAUER Spezialtiefbau GmbH, Schrobenhausen (DE)

(72) Inventors: Fadi Haddad, Schrobenhausen (DE); Luan Nguyen, Schrobenhausen (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 350 days.

(21) Appl. No.: 17/996,998

(22) PCT Filed: Mar. 4, 2021

(86) PCT No.: PCT/EP2021/055475
§ 371 (c)(1),
(2) Date: Oct. 24, 2022

(87) PCT Pub. No.: WO2021/213723
PCT Pub. Date: Oct. 28, 2021

(65) Prior Publication Data

US 2023/0127152 A1 Apr. 27, 2023

(30) Foreign Application Priority Data

Apr. 24, 2020 (EP) ..... 20171277

(51) Int. Cl.
*E02D 1/02* (2006.01)
*E02D 1/08* (2006.01)

(52) U.S. Cl.
CPC ..... *E02D 1/022* (2013.01); *E02D 1/08* (2013.01)

(58) Field of Classification Search
CPC ..... E02D 1/022; E02D 1/08
See application file for complete search history.

(56) References Cited

U.S. PATENT DOCUMENTS 8,990,027 B2 3/2015 Hovhanessian et al.
12,104,342 B2 * 10/2024 Regler ..... E02D 1/02
(Continued)

FOREIGN PATENT DOCUMENTS

EP 2 391 776 B1 3/2016
EP 3 109 365 A1 12/2016
JP 2018-024985 A 2/2018

OTHER PUBLICATIONS

International Preliminary Report on Patentability issued in PCT/EP2021/055475; Date of completion of this report: Jul. 14, 2022.
(Continued)

*Primary Examiner* — Clayton E. LaBalle
*Assistant Examiner* — Diana Hancock
(74) *Attorney, Agent, or Firm* — Studebaker Brackett PLLC

(57) ABSTRACT

The invention relates to a method and an arrangement for monitoring a structural foundation in a ground for a structure, wherein ground parameters are determined for the ground, based on the determined ground parameters a preliminary ground model is calculated by means of a computer unit, on which a design of the structural foundation is laid out taking into consideration specification data of the structure to be erected, during and/or after the production of the structural foundation measured values relating to settlements, distortions and/or forces on the structural foundation or the structure are recorded by means of measuring means, the measured values are forwarded to the computer unit which checks if the measured values are consistent with the preliminary ground model, and if the measured values are not consistent with the preliminary ground model, a subsequent ground model, in which the measured values are consistent with the new ground model, is calculated by the computer unit.

9 Claims, 2 Drawing Sheets

(56) References Cited

U.S. PATENT DOCUMENTS

Figure 1:
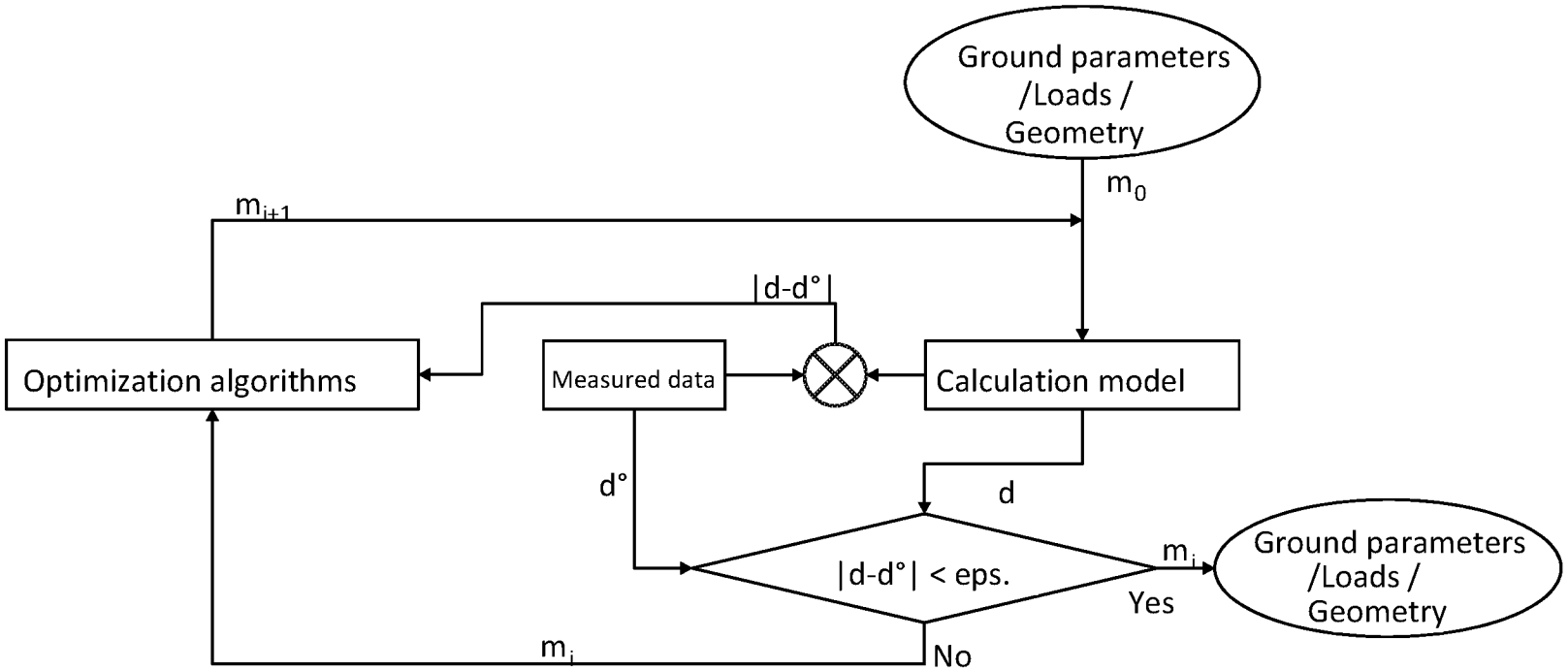

| | | | | |
|---|---|---|---|---|
| 2014/0219726 | A1* | 8/2014 | Degen | E02D 5/66<br>405/232 |
| 2016/0369471 | A1* | 12/2016 | Jussel | E02D 1/022 |
| 2019/0234035 | A1* | 8/2019 | Nagy | E02D 3/074 |
| 2020/0393595 | A1* | 12/2020 | Lee | G06F 30/13 |

OTHER PUBLICATIONS

International Search Report issued in PCT/EP2021/055475; mailed May 17, 2021.

* cited by examiner

METHOD AND ARRANGEMENT FOR MONITORING A STRUCTURAL FOUNDATION

The invention relates to a method for monitoring a structural foundation in a ground for a structure according to claim 1.

The invention further relates to an arrangement for monitoring a structural foundation in a ground for a structure according to claim 9.

To monitor structural foundations it is generally known to provide in the foundation of a structure or on it different sensors, through which the state of the structural foundation can be monitored. With such sensors distortions, cracks, settlements or forces in the structural foundation can be measured. It is furthermore known to forward the measured data to a control center that compares the measured values with stored limit values in order to ascertain thereby at an early stage if excessive or inadmissible changes occur on the structural foundation. For instance this provides the possibility to carry out retrofit measures on the structural foundation or the structure at an early stage to prevent greater damage.

Such a system of monitoring a structure relating to a bridge is described, for example, in U.S. Pat. No. 8,990,027 B2 or in EP 2 391 776 B1 corresponding thereto.

To determine the load-bearing capacity of a structural foundation the conditions of the ground, in which the structural foundation is to be produced, are of vital importance. The structural foundation is to be laid out depending on the load-bearing capacity of the ground. Especially in the case of larger structures a determination of the ground conditions in the most realistic way as possible is of decisive importance. For instance, a structural foundation must be laid out completely different on soft or sandy ground than on rocky ground. However, on many construction sites the ground conditions are unclear since the ground is composed of different layers with varying layer thicknesses, for example, or various ground regions containing rock, gravel, sand, clay and cavities are present.

When producing larger structures it is therefore common practice to carry out test drillings in several places of a construction site in order to gain detailed knowledge on the precise ground composition. Based on the individual test drillings a ground model is then calculated which, along with precautionary safety margins, is taken as a basis for the design of the structural foundation. Especially on construction sites with non-homogeneous ground the ground model thus determined can, to some extent, deviate considerably from the actual ground conditions. In such a case, greater safety margins must generally be provided for the design of the foundation, which can lead to significantly higher costs, e.g. due to an increase in the number and/or size of foundation piles, anchorings, reinforcement rods and a greater amount of concrete.

Moreover, a problem resides in the fact that despite corresponding safety margins the occurrence of larger-than-expected deviations between the ground model and the actual ground conditions can, in the long run, give rise to damage on the structure and also reduce the lifespan of a structure.

The invention is based on the object to provide a method and an arrangement which enable a particularly reliable monitoring of a state of a structural foundation.

The object is achieved on the one hand by a method having the features of claim 1 and on the other hand by an arrangement having the features of claim 9. Preferred embodiments of the invention are stated in the dependent claims.

According to the invention a method for monitoring a structural foundation in the ground for a structure is provided, wherein ground parameters are determined for the ground, based on the determined ground parameters a preliminary ground model is calculated by means of a computer unit, on which a design of the structural foundation is laid out taking into consideration specification data of the structure to be erected, during and/or after the production of the structural foundation measured values relating to settlements, distortions and/or forces on the structural foundation or the structure are recorded by means of measuring means, the measured values are forwarded to the computer unit which checks if the measured values are consistent with the preliminary ground model and, if the measured values are not consistent with the preliminary ground model, a subsequent ground model, in which the measured values are consistent with the new ground model, is calculated by the computer unit.

Unlike the classical monitoring methods, the invention is not limited to recording measured data on a structural foundation with a structure and to comparing the measured data with limit values as to whether a structural foundation or a structure still reacts in an expected and admissible way or whether changes occur that necessitate the initiation of safeguarding measures.

With regard to monitoring, the method according to the invention goes far beyond previously known methods. By way of the method according to the invention a check is made as to whether the measured values of the sensors on the structural foundation or the structure are consistent with the ground model, on which the design of the structural foundation was based. If these measured values lie in the expected value range that was determined on the basis of the preliminary ground model, a correct state of the structure is established. If individual or several measured values on the structural foundation or the structure show unexpected or excessive deviations, even if the individual values should not be critical or problematic for the structure, according to the method pursuant to the invention a new subsequent ground model can be calculated, in which the current measured values are consistent with the values to be expected by calculation or lie within the expected value range. Based on this new subsequent ground model a retrospective calculation or a renewed calculation of the structural foundation can then take place and a check can be made as to whether this still corresponds to the specification data for the structure.

Hence, in the method according to the invention measured values on the structural foundation or on a structure are drawn upon to determine a refined ground model. This refined and therefore more realistic ground model can then be used to check the extent to which the structural foundation complies with the requirements.

Therefore, it can be considered as a basic idea of the invention that measured data on a structural foundation and, where applicable, on a structure are used to draw conclusions as to the nature of the ground and to refine an original or preliminary ground model and align this closer to reality.

According to a further development of the invention it is particularly advantageous that the preliminary ground model is compared with the subsequent ground model as to what extent specification data of the foundation are met. In particular, constructional measures can then be ascertained or suggested by the computer unit in order to meet the specification data or achieve or ensure requirements relating to the new ground model.

It is particularly expedient that the specification data comprise a load-bearing capacity and/or lifespan of the structural foundation or the structure. In particular the load-bearing capacity of a structural foundation constitutes a significant specification that must be met in order to erect a structure on the structural foundation. Especially in the case of dams that are frequently equipped with perimeter walls in the ground a lifespan of both the dam and the perimeter walls in the ground, which, within the meaning of the invention, are also to be considered as a structural foundation, is a decisive specification factor. Particularly concerning such structures or constructional projects a more detailed knowledge of the ground can result in considerable extensions or reductions of the lifespan. Especially in the case of dams reliable information on the expected lifespan can have an impact on the type and number of maintenance and/or retrofit measures as well as on the premium rate of necessary building insurances.

Basically, the ground parameters used to determine the first ground model can be ascertained in any suitable way, for instance through empirical values of the area, in which the construction site is located, or through findings gained from other comparable construction projects in the area. According to an embodiment variant of the invention it is especially advantageous that the ground parameters are determined through ground analyses, in particular test drillings. In particular, core drillings can be carried out, in which case the drill cores obtained can be used to ascertain a composition of the ground. Furthermore, drillings with probes or soundings from the ground surface can also be carried out to ascertain ground parameters.

Furthermore, it is particularly expedient that the ground parameters comprise type, composition and size of ground layers as well as a load-bearing capacity of the ground. This can also include the recording of a rock horizon in the ground. In this way, a particularly good and realistic determination can already be achieved for the first ground model to be calculated.

To record changes on the structural foundation or the structure any type of suitable measuring means can be employed. According to a further development of the invention it is particularly expedient that as measuring means sensors, in particular strain gauges and/or load cells, are mounted on or in the structural foundation and/or the structure. From the time of installation and over a long period of several years or decades these sensors can record measured data which allow a reliable conclusion as to the state of the structural foundation or the structure.

Depending on the situation of installation the measuring means can be connected in a wire-based manner to the computer unit or to a transmitter unit. According to an embodiment variant of the invention a particularly versatile arrangement resides in the fact that the measuring means are wirelessly connected to the computer unit. In this way, the measuring means can be queried constantly or at predetermined intervals by a central computer unit or a mobile computer unit. In conjunction with this it can be particularly useful that the measuring means are entirely or largely autonomous in terms of energy by being equipped with a lifespan battery for example. Moreover, it can be advantageous for the measuring means to be provided with a transponder which, on receiving an incoming signal that at the same time transmits the necessary energy, carries out a measurement and/or passes measured data via a transmitter unit to the computer unit.

An especially reliable monitoring of a structure or a structural foundation is accomplished in that the method is carried out repeatedly, in particular at regular intervals. If, in doing so, measured values are received that show no changes or those to be expected on the basis of the preliminary ground model, no further calculations are necessary as the structure or the structural foundation is in a correct state. If, however, the transmitted measured values show changes exceeding permissible limits the computer unit checks if and to what extent the preliminary ground model has to be refined or corrected. This results in a subsequent ground model, on the basis of which the design of the structure is again checked and calculation is made as to what extent all relevant specification data are met including consideration being given to the new ground model.

Basically, the method according to the invention can be applied such that the subsequent ground models are only implemented after completion of a structural foundation or of the structure as a whole. According to a further development of the invention, however, it can be particularly efficient that when recording the measured values, while still producing the structural foundation, the subsequent ground model is taken into consideration for the design of the structural foundation in subsequent construction stages. Especially in the case of larger structures that are produced in individual construction stages findings and measured values relating to a first completed construction stage can already be processed by way of the method according to the invention as to whether and to what extent the preliminary underlying ground model has been ascertained in line with reality. As a result, where necessary, refined ground models can be taken into consideration in the implementation of subsequent construction stages, for instance for the design of foundation piles, retaining walls, tie-back anchorings etc.

An improvement of structural safety is in particular achieved in that a warning is issued by the computer unit if specification data for the structural foundation are no longer met in the subsequent ground model. In such a case, remediation or safeguarding measures can be undertaken to ensure the safety of the structure and, where necessary, of users. For example additional foundation piles or reinforcements can be introduced if need be. In addition, the structure could be relieved through relief measures, thereby counteracting the risk of excessive stress.

The invention further relates to an arrangement for monitoring a structural foundation in a ground for a structure, having a computer unit, by which, based on determined ground parameters, a preliminary ground model can be ascertained, on the basis of which a design of the structural foundation takes place in consideration of specification data, and measuring means on the structural foundation or the structure, wherein the measuring means record settlements, distortions and/or forces on the structural foundation or the structure, wherein the computer unit has a data connection to the measuring means for the transmission of measured data and by the computer unit a check can be made as to whether the measured values are consistent with the first ground model, and by the computer unit a subsequent ground model can be calculated, in which the measured values are consistent with the subsequent ground model, if the measured values are not consistent with the preliminary ground model.

With this arrangement the previously described method according to the invention can be carried out in particular. The advantages set out previously can be achieved thereby.

Figure 2:
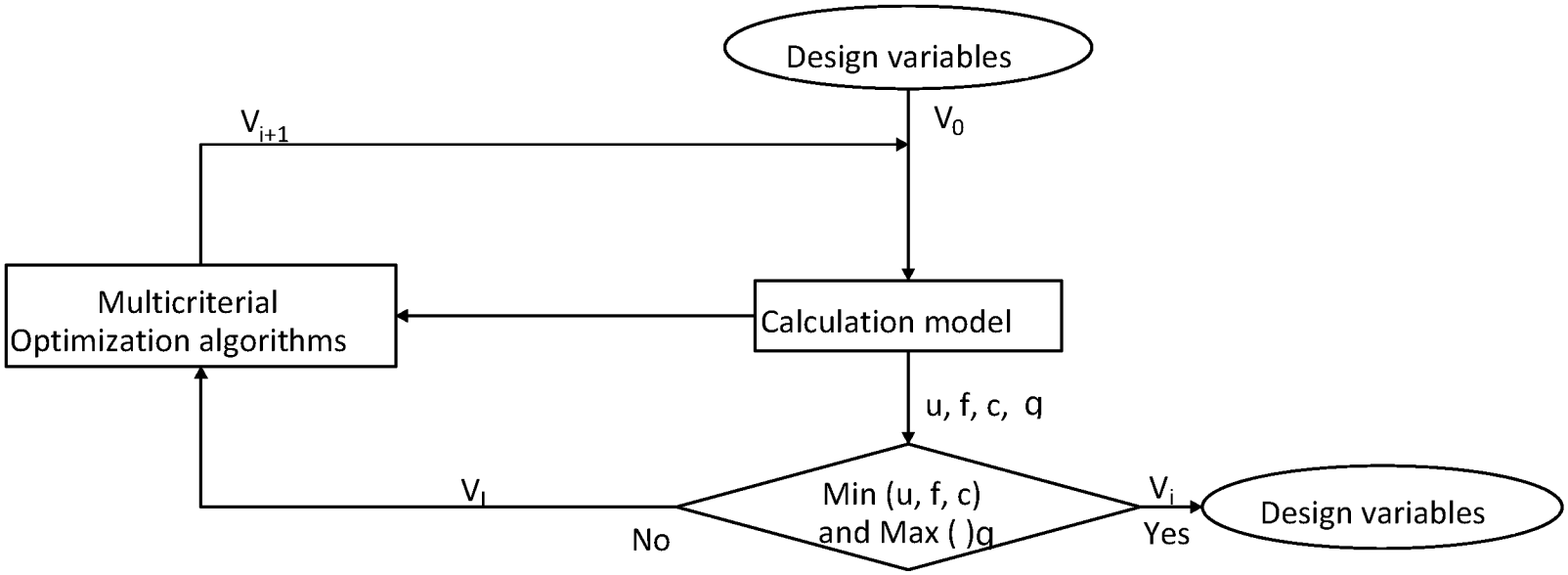

The invention is explained further hereinafter by way of sequence diagrams of preferred embodiments. In the drawings show:

FIG. 1 a first schematic sequence diagram of the method according to the invention; and FIG. 2 a further schematic sequence diagram relating to a further development of the method according to the invention.

In FIG. 1 the determining of the ground model, referred to as calculation model here, is elucidated further. Based on specified ground parameters that can comprise a stiffness modulus or a specific weight of the ground and ground shear parameters as well as loads from the surrounding area and geometrical conditions, such as the strength of ground layers, a first ground model is calculated.

Furthermore, on the structural foundation and the structure, which can also include the construction site and the construction ground, measured data or measured values, e.g. relating to distortions, settlements, anchoring and lateral forces can be recorded by corresponding sensor means. According to the method pursuant to the invention these measured data or measured values which are indicated as d0 are compared with the measured values d to be expected that theoretically result from the calculation model. If a difference between the theoretically ascertained nominal values d and the actually measured values d0 lies within a tolerance eps, the input ground parameters are confirmed. In this case, a recalculation of the ground or calculation model does not take place.

However, if the difference value between the nominal values and the actual values exceeds the specified tolerance range eps, a computer unit carries out optimization algorithms, in which the previously assumed ground parameters are changed until a subsequent ground model or calculation model is developed on the basis of changed ground parameters mi that represent the actual conditions of the ground more realistically.

According to FIG. 2 the new ground model or calculation model thus ascertained can then be used for a retrospective calculation or recalculation of the design of the structural foundation or the structure. For this, initially the original design variables concerning the layout, which can be, for example, related to the securing of an excavation pit, an installation depth, number, length and position of the anchors, diameter and spacing of a pile wall and thickness of a diaphragm wall, are checked again and recalculated on the basis of the new calculation model.

In doing so, specification can be made by the computer unit as to a minimization e.g. of settlements and cutting forces in wall, base plate and foundation elements and of overall costs as well as to a maximization of the structural safety for example. On the basis of these specifications the computer unit can, by way of multicriterial optimization algorithms, calculate e.g. for further construction stages if design variables can or have to be changed under the specified criteria. In this way, for example a material-optimized, cost-efficient and/or particularly safe structural design can be accomplished.

The invention claimed is:

1. A method for monitoring a structural foundation in a ground for a structure, wherein ground parameters are determined for the ground, based on the determined ground parameters a preliminary ground model is calculated by means of a computer unit, on which a design of the structural foundation is laid out taking into consideration specification data of the structure to be erected, during and/or after the production of the structural foundation measured values relating to settlements, distortions and/or forces on the structural foundation or the structure are recorded by means of measuring means, the measured values are forwarded to the computer unit which checks if the measured values are consistent with the preliminary ground model, and if the measured values are not consistent with the preliminary ground model, a subsequent ground model, in which the measured values are consistent with the new ground model, is calculated by the computer unit, wherein the preliminary ground model is compared with the subsequent ground model as to what extent specification data of the foundation are met, and wherein a warning is issued by the computer unit if specification data for the structural foundation are no longer met in the subsequent ground model.

2. The method according to claim 1, wherein the specification data comprise a load-bearing capacity and/or lifespan of the structural foundation or the structure.

3. The method according to claim 1, wherein the ground parameters are determined through ground analyses, in particular test drillings.

4. The method according to claim 1, wherein the ground parameters comprise type, composition and size of ground layers as well as a load-bearing capacity of the ground.

5. The method according to claim 1, wherein as measuring means sensors, in particular strain gauges and/or load cells, are mounted on or in the structural foundation and/or the structure.

6. The method according to claim 1, wherein the measuring means are wirelessly connected to the computer unit.

7. The method according to claim 1, wherein the method is carried out repeatedly, in particular at regular intervals.

8. The method according to claim 1, wherein when recording the measured values, while still producing the structural foundation, the subsequent ground model is taken into consideration for the design of the structural foundation in subsequent construction stages.

9. An arrangement for monitoring a structural foundation in a ground for a structure, for carrying out the method according to claim 1, having a computer unit, by which, based on determined ground parameters, a preliminary ground model can be ascertained, on the basis of which a design of the structural foundation takes place in consideration of specification data, and measuring means on the structural foundation or a structure, wherein settlements, distortions and/or forces on the structural foundation or the structure can be recorded by the measuring means, wherein the computer unit has a data connection to the measuring means for the transmission of measured data and by the computer unit a check can be made as to whether the measured values are consistent with the first ground model, wherein by the computer unit a subsequent ground model can be calculated, in which the measured values are consistent with the subsequent ground model, if the measured values are not consistent with the preliminary ground model, wherein by means of the computer unit the preliminary ground model is compared with the subsequent ground model as to what extent specification data of the foundation are met, and wherein a warning can be issued by the computer unit if specification data for the structural foundation are no longer met in the subsequent ground model.

* * * * *